US008830285B2

(12) United States Patent
Mori

(10) Patent No.: US 8,830,285 B2
(45) Date of Patent: Sep. 9, 2014

(54) PRINTING APPARATUS AND PRINTING METHOD

(71) Applicant: Toshiba TEC Kabushiki Kaisha, Tokyo (JP)

(72) Inventor: Futoshi Mori, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/953,876

(22) Filed: Jul. 30, 2013

(65) Prior Publication Data

US 2014/0036019 A1 Feb. 6, 2014

(30) Foreign Application Priority Data

Aug. 3, 2012 (JP) ..... 2012-172971

(51) Int. Cl.
*B41J 2/32* (2006.01)

(52) U.S. Cl.
USPC ..... 347/197

(58) Field of Classification Search
USPC ..... 347/197
See application file for complete search history.

(56) References Cited

U.S. PATENT DOCUMENTS 5,115,253 A * 5/1992 Yorozu et al. ..... 347/197
5,631,688 A * 5/1997 Hibino et al. ..... 347/171
8,446,441 B2 * 5/2013 Yamada ..... 347/197

FOREIGN PATENT DOCUMENTS

JP 11-208058 8/1999

OTHER PUBLICATIONS

Japanese Office Action for Japanese Application No. 2012-172971 mailed on Jun. 10, 2014.

* cited by examiner

*Primary Examiner* — Kristal Feggins
(74) *Attorney, Agent, or Firm* — Amin, Turocy & Watson, LLP

(57) ABSTRACT

A printing apparatus includes a thermal head has a heat generating element that thermally transfer ink of a ink ribbon onto a recording medium, a conveying unit conveys the recording medium towards the thermal head along a conveyance path, a platen member is positioned opposite to the thermal head in the conveyance path, a moving mechanism moves the thermal head between a first position where the ink is thermally transferred to the recording medium by pressurizing the platen member and a second position departing from the platen member and an adjusting unit, in a condition that the time of moving the thermal head from the second position to the first position is different from a specified time, adjusts a movement timing of the thermal head or a movement time of the thermal head by the moving mechanism according to the difference between the time and the specified time.

5 Claims, 8 Drawing Sheets

PRINTING APPARATUS AND PRINTING METHOD

CROSS-REFERENCE TO RELATED APPLICATION

This application is based upon and claims the benefit of priority from Japanese Patent Application No. 2012-172971, filed Aug. 3, 2012, the entire contents of which are incorporated herein by reference.

FIELD

Embodiments described herein relate to a printing apparatus and a printing method that thermally transfers ink to a recording medium from an ink ribbon by a thermal head and carries out printing.

BACKGROUND

Generally, as a printing apparatus that prints barcode and the like onto a recording medium (label paper) using an ink ribbon, there is known a thermal printer such as a label printer or a barcode printer and the like. The thermal printer includes a thermal head arranging multiple heat generating elements in a direction (horizontal scanning direction) perpendicular to a conveyance direction of the label paper.

The thermal head, arranged opposite to a platen roller, conveys the label paper fed from a paper roll along a conveyance path, and sandwiches the label paper and the ink ribbon in between the thermal head and the platen roller, and then pressurizes. Then, the platen roller is driven to rotate by a drive motor to convey label paper, and heat generating elements of the thermal head are contacted with the ink ribbon to thermally transfer the ink from the ink ribbon to the label paper. The conveyance of the ink ribbon is carried out by a ribbon motor, and the ink ribbon moves along the conveyance path while rewinds to a ribbon winding roller (See Japanese Unexamined Patent Application Publication No. Hei 10-157244).

Also, the conventional printing apparatus has a ribbon save function reducing the use amount of the ink ribbon. The ribbon save function operates the following actions: raising the thermal head and stopping the rotation of the ribbon motor for a non-printing area of the printing pattern, and declining the thermal head to print if the paper is conveyed to a printing area. Hereinafter, raising the thermal head is called head up, and declining the thermal head is called head down.

However, the time from a firmware demands the head down to the thermal head is actually fixed onto the paper is determined by a variation of ambient temperature or the mechanism. Therefore, there exists an issue such as the printing is started while the thermal head remains not fixed onto the paper, and the printing is not correctly carried out, and white blank occurs.

DETAILED DESCRIPTION

In accordance with an embodiment, a printing apparatus includes a thermal head configured to have a heat generating element that thermally transfer ink of an ink ribbon onto a recording medium, a conveying unit configured to convey the recording medium towards the thermal head along a conveyance path, a platen member configured to be positioned opposite to the thermal head in the conveyance path, a moving mechanism configured to move the thermal head between a first position where the ink is thermally transferred to the recording medium by pressurizing the platen member and a second position departing from the platen member and an adjusting unit configured to, in a condition that the time of moving the thermal head from the second position to the first position is different from a specified time, adjust at least one of a movement timing of the thermal head and a movement time of the thermal head by the moving mechanism according to the difference between the time and the specified time.

Hereinafter, the embodiments for implementing the invention are described with reference to the drawings. Moreover, in each drawing the same part is marked with the same reference number.

A First Embodiment

Figure 1:
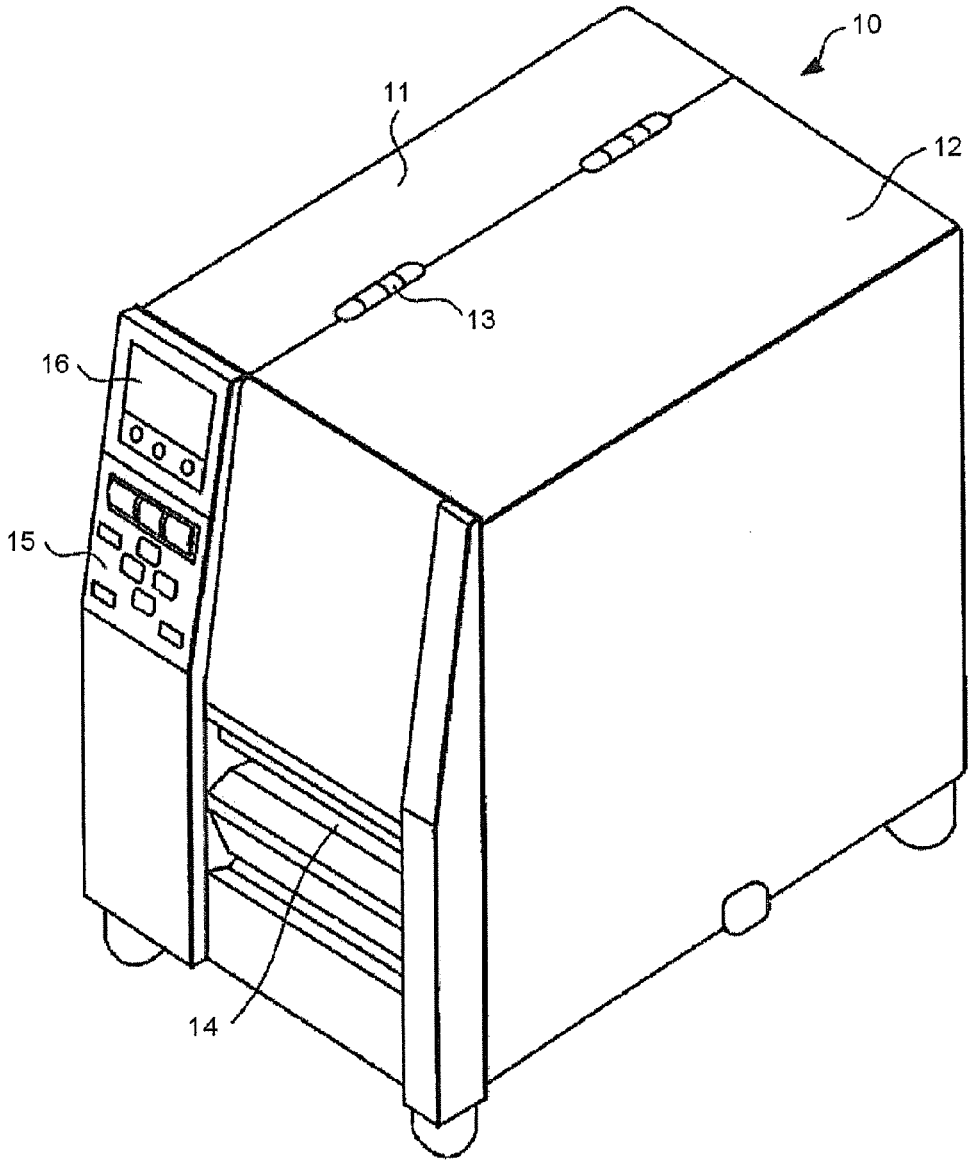
FIG. 1 is a perspective view illustrating an overall configuration of a printing apparatus according to one embodiment.

FIG. 1 is a perspective view illustrating an overall configuration of the printing apparatus according to one embodiment. In FIG. 1, the printing apparatus 10 comprises a control box 11 storing a printer engine, and a cover 12 rotatably connected to the control box 11 via a hinge 13. Also, a discharge port 14 discharging the printed recording medium (label paper) is arranged at the front face of the cover 12; and an operation unit 15 and a display unit 16 displaying operating information or operating menu are arranged at the front face of the control box 11. The display unit 16 is composed of a liquid crystal screen and the like.

Figure 2:
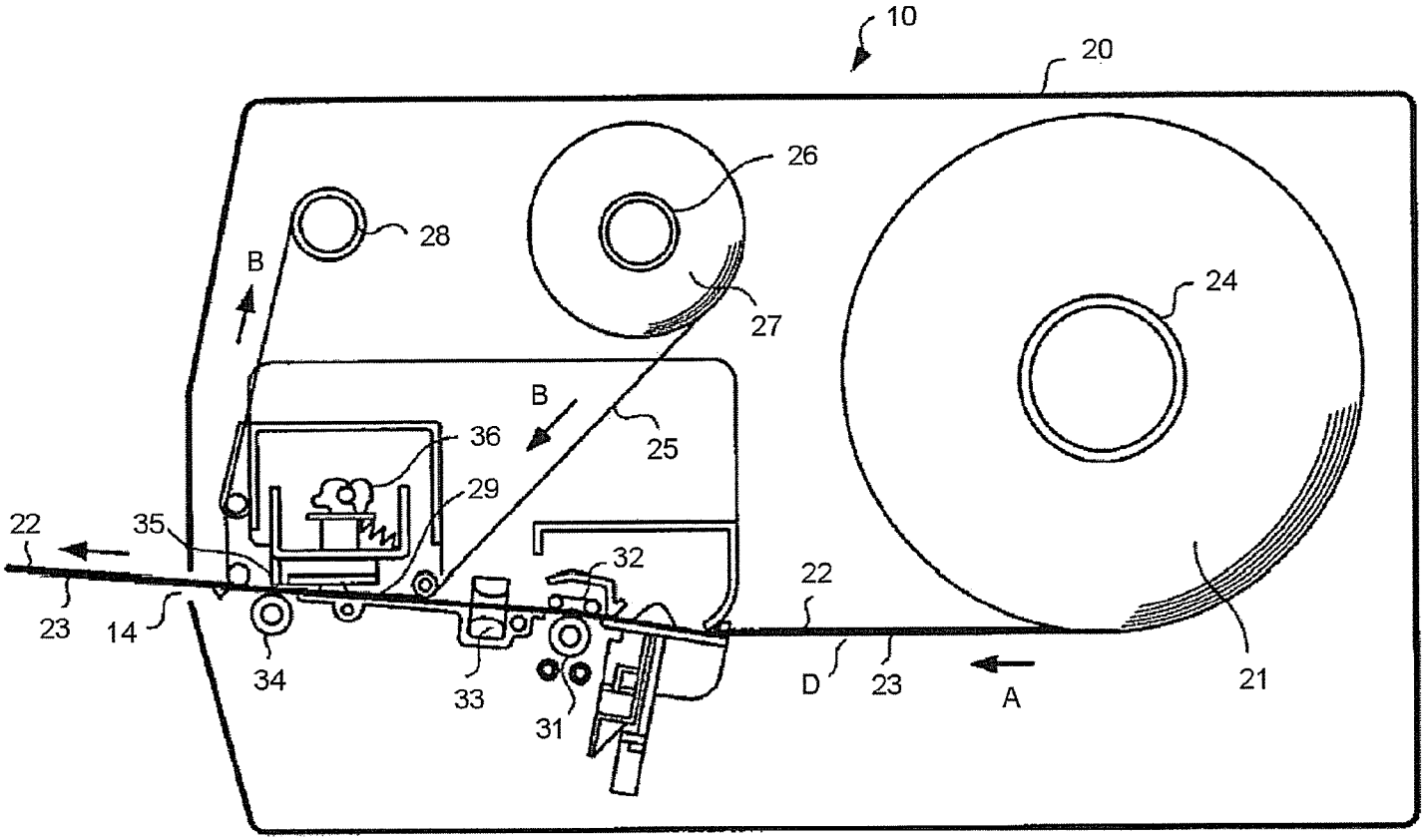
FIG. 2 is a configuration diagram illustrating an internal structure of the printing apparatus according to one embodiment.

FIG. 2 is a configuration diagram illustrating the internal structure of the printing apparatus 10, and illustrating a state of the cover 12 of FIG. 1 being opened.

In FIG. 2, a paper roll 21 is housed in a housing 20. The paper roll 21 is rotatably retained at a holding unit 24. The paper roll 21 is rolled up a mount 23 with a label paper 22 as the recording medium in a roll shape, and the mount 23 faces outward. In the label paper 22, an adhesive layer is arrange at a face contacting with mount 23, and the label paper 22 can be peeled off from the mount 23 if needed. Hereinafter, the label paper 22 and the mount 23 are collectively referred to as paper D. The paper D is conveyed in a direction of arrow A of FIG. 2.

Also, the interior of the housing 20 includes an ink ribbon roll 27 that rewinds an ink ribbon 25 onto a ribbon feed shaft 26, and a ribbon winding shaft 28 that rewinds and retains the ink ribbon 25 fed from the ink ribbon roll 27. The ink ribbon 25 fed from the ink ribbon roll 27 is fed in a direction of arrow B, and rewound onto the ribbon winding shaft 28 via a conveyance path 29.

Furthermore, the interior of the housing 20 includes: a conveyance roller 31 conveying the paper D fed from the paper roll 21 and a pinch roller 32, a paper detection sensor 33 detecting the paper D, and a platen member (platen roller) 34 conveying the ink ribbon 25 and paper D. The conveyance roller 31, the pinch roller 32 and the platen roller 34 and the like are in a conveyance path of the paper D. Also, the conveyance roller 31, the pinch roller 32 and the platen roller 34 and the like constitute a conveying unit that conveys the paper D fed from the paper roll 21 along the conveyance path.

A thermal head 35 is arranged opposite to the upper side of the platen roller 34. The ink ribbon 25 and the paper D are sandwiched between the platen roller 34 and the thermal head 35. The thermal head 35 is fixed at the undersurface of a moving mechanism 36, and heat generating elements are arranged at the apical portion of the undersurface of the thermal head 35. Along an axis direction of the platen roller 34, multiple heat generating elements are arranged at a specified interval in a direction (horizontal scanning direction) perpendicular to the conveyance direction of the label paper 22.

A conveyance path 29 of the ink ribbon feeds the ink ribbon 25 wound at the ink ribbon roll 27 towards the label paper 22. The ink ribbon 25, changes its direction to upward and is rewound onto a ribbon winding shaft 28 after passing through the space between the platen roller 34 and the thermal head 35 at a state of overlapping on the label paper 22.

The thermal head 35 is raised and declined against the platen roller 34 by a moving mechanism 36. When the thermal head 35 declines, the ink ribbon 25 and the label paper 22 are pressed onto the platen roller 34, and ink is thermally transferred from the ink ribbon 25 to the label paper 22 to print. Also, if the thermal head 35 raises, it departs from the platen roller 34 to stop printing.

That is, when the thermal head 35 declines (head down) to the first position, it turns into a printing state, and when the thermal head 35 raises (head up) to the second position it turns into a non-printing state. Then, the printed paper D is discharged from the discharge port 14.

Figure 3:
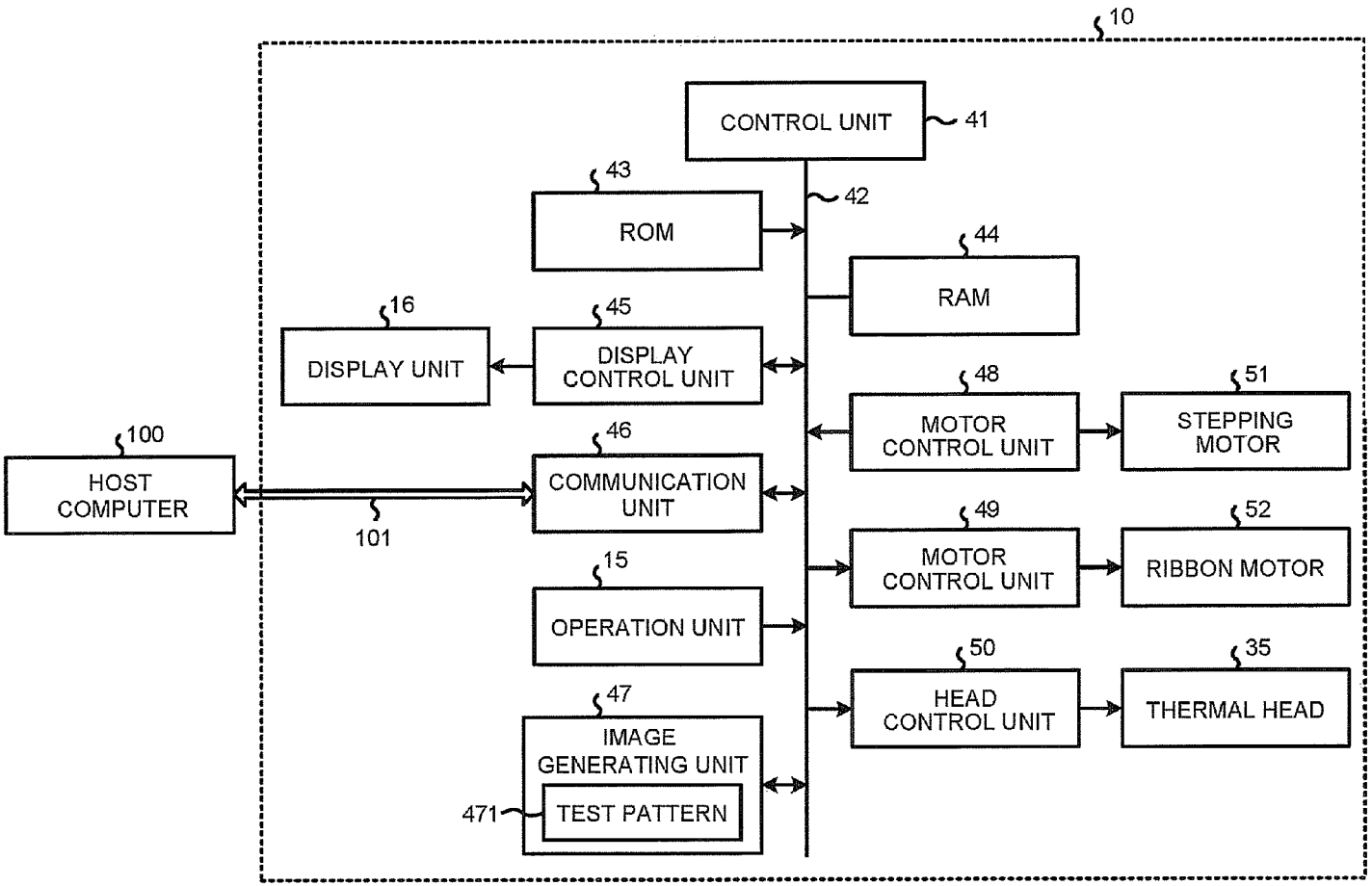
FIG. 3 is a block diagram illustrating a control system of the printing apparatus according to one embodiment.

FIG. 3 is a block diagram illustrating a control system of the printing apparatus 10 according to one embodiment. In FIG. 3, the printing apparatus 10 includes a control unit 41 to which a ROM (Read Only Memory) 43, a RAM (Random Access Memory) 44, a display control unit 45, a communication unit 46, an operation unit 15 and an image generating unit 47 are connected through a bus line 42.

The control unit 41 comprises a CPU controlling all the actions. Operating information or setting information and action method and the like are stored in the ROM 43, and various processing information are stored in the RAM 44. The display control unit 44 controls the display unit 16, and the communication unit 46 carries out communication with a host computer 100 arranged outside and the like. The operation unit 15 comprises, for example, various input keys for an operator manually inputting data.

An image generating unit 47 generates a label image to be printed onto the label paper 22, for example, an image of barcode or QR code (registered trademark) and the like. That is, an image buffer according to a specified paper size is offered within the image generating unit 47, and a two-dimensional code such as barcode or character are drawn into the image buffer, and the data drawn into the image buffer are transported to the thermal head 35 for each line to carry out printing in the label paper 22 of the paper D. The image generating unit 47 includes a test pattern generating unit 471.

Furthermore, motor control units 48, 49 and a head control unit 50 are connected to the bus line 42. The motor control unit 48 controls the rotation of a stepping motor 51 driving the rotation of the paper roll 21 or the conveyance roller 31 constituting the conveying unit, the pinch roller 32, the platen roller 34 and the like. Also, the motor control unit 49 controls the rotation of the ribbon motor 52 driving the ribbon winding shaft 28.

The head control unit 50 controls the moving mechanism 36 to raise and decline the thermal head 35, and carries out the control of printing or non-printing onto the label paper 22. Also, the head control unit 50 controls heat generating state of the heat generating elements of the thermal head 35.

The printing apparatus 10 of FIG. 3, under the control of the control unit 41, according to an instruction from the operation unit 15 or the host computer 100, prints ink onto the label paper 22 as a recording medium by the thermal head 35, and conveys the printed paper D towards the discharge port 14 and discharges the printed paper D. When printing onto the label paper 22, the operator operates the operation unit 15, and displays a menu screen and the like onto the display unit 16 thereby carrying out a printing instruction. Alternatively, the printing instruction is carried out according to an input from the host computer 100.

Figure 4:
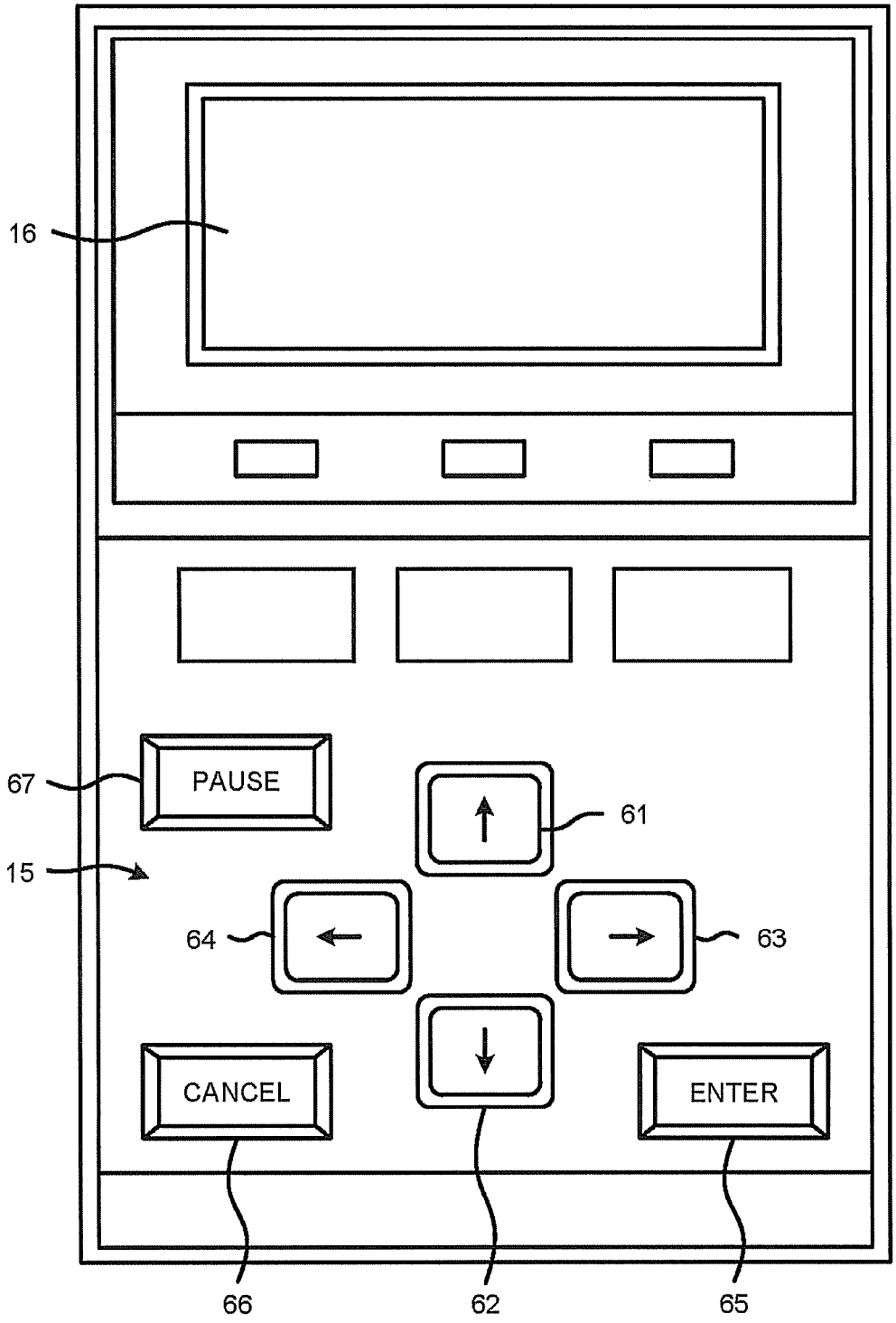
FIG. 4 is an enlarged front view illustrating an operation unit and a display unit of the printing apparatus according to one embodiment.

FIG. 4 is an enlarged front view of the operation unit 15 and the display unit 16 of FIG. 1. In FIG. 4, the operation unit 15 comprises an upward cursor key 61, a downward cursor key 62, a rightward cursor key 63, and a downward cursor key 64. Also, the operation unit 15 comprises an Enter key 65, a Cancel key 66, a Pause key 67 and the like.

Figure 5:
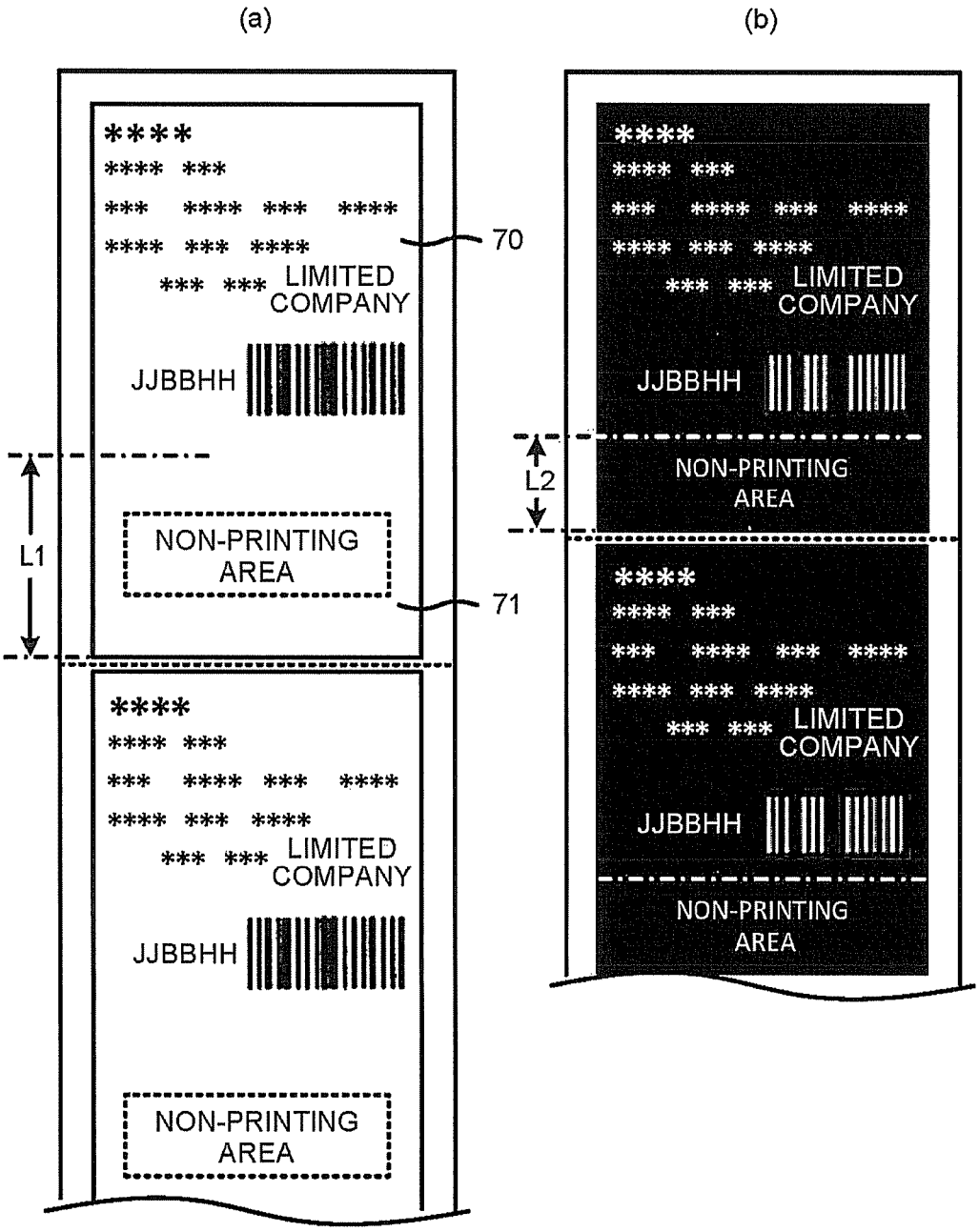
FIG. 5 is an illustration diagram illustrating a ribbon save function of the printing apparatus according to one embodiment.

Also, the printing apparatus 10 has a ribbon save function reducing the use amount of the ink ribbon. As shown in FIG. 5 (a), when the label image 70 is printed onto the label paper 22, if there is a non-printing area 71 (shown as length L1), the ribbon save function conducts the following actions: raising the thermal head 35 (head up) and stopping the rotation of the ribbon motor 52, and if the paper D is transferred to a printing area, rotating the ribbon motor 52 and declining the thermal head 35 (head down) to print. Therefore, as shown in FIG. 5(*b*), the use amount of the ink ribbon is reduced for the non-printing area 71. If the use length of the ink ribbon at the non-printing area is set as L2, then L2 is smaller than L1.

On the other hand, the time from receiving a demand of head down to the thermal head 35 is actually firmly fixed on the label paper 22 is uneven due to a variation of ambient temperature or moving mechanism of the thermal head 35. Therefore, in the embodiment, in a condition that the time of moving the thermal head 35 from the second position (head up position) to the first position (head down position) is different from the specified time, can adjust at least one of a movement timing of the thermal head and a movement time of the thermal head by the moving mechanism according to the difference between the time of moving the thermal head 35 from the second position to the first position and the specified time.

Figure 6:
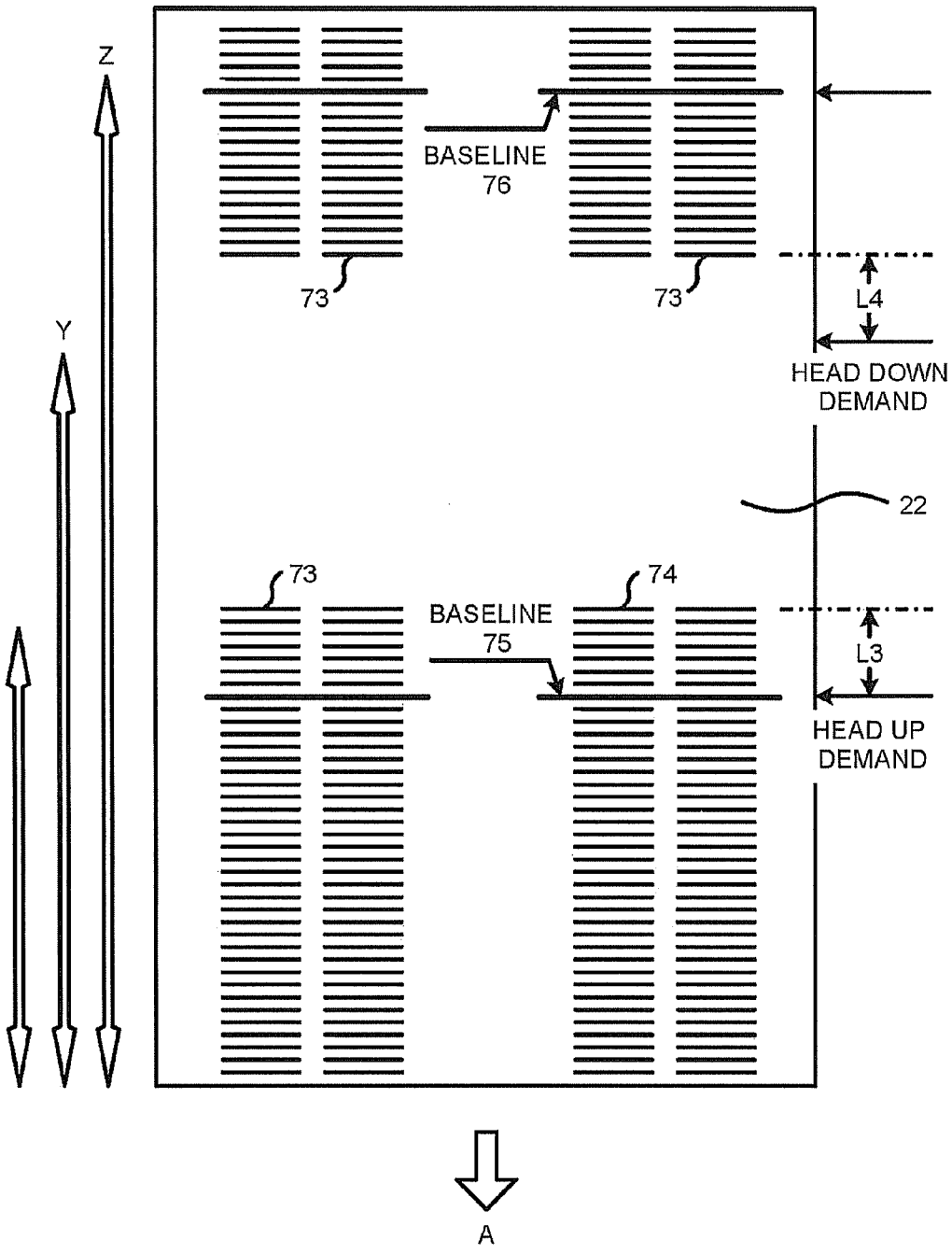
FIG. 6 is an illustration diagram illustrating one example of a test pattern of one embodiment.

Hereinafter, a method for adjusting the head down or head up of the thermal head 35 is described. FIG. 6 is an illustration diagram illustrating a test pattern measuring a response time of head up and head down of the thermal head 35. Test patterns 73, 74 are generated at a test pattern generating unit 471 of the image generating unit 47, when the conveyance direction of the label paper 22 is set as A, the test patterns 73, 74 are printed side-by-side along the conveyance direction.

In a off-line mode such as maintenance and the like, if an adjustment mode is selected, then printing is carried out by using the test patterns 73, 74. First, at the time of printing at a distance X from a printing position, a head up demand is sent. In the timing of demanding head up, a baseline 75 is drawn. A conveyance distance L3 from the head up demand to the actual head up can be measured, based on how much is the distance (time) from a baseline 75 at which the printing is unable to print. At the time of head up, the printing is not carried out.

Next, after conveyance distance Y, if head down is demanded, the thermal head 35 is fixed on the label paper 22 and printing is started. A baseline 76 is drawn at a position of a preset distance (time) after head down is demanded. Therefore, a conveyance distance L4 from the time when a head down is demanded to the thermal head is actually fixed can be measured based on at what time before the baseline 76 the printing is started. Also, a left and right position deviation of the thermal head 35 (inclined state of the thermal head) can also be known by printing the same test patterns 73, 74 at the left and right.

Figure 7:
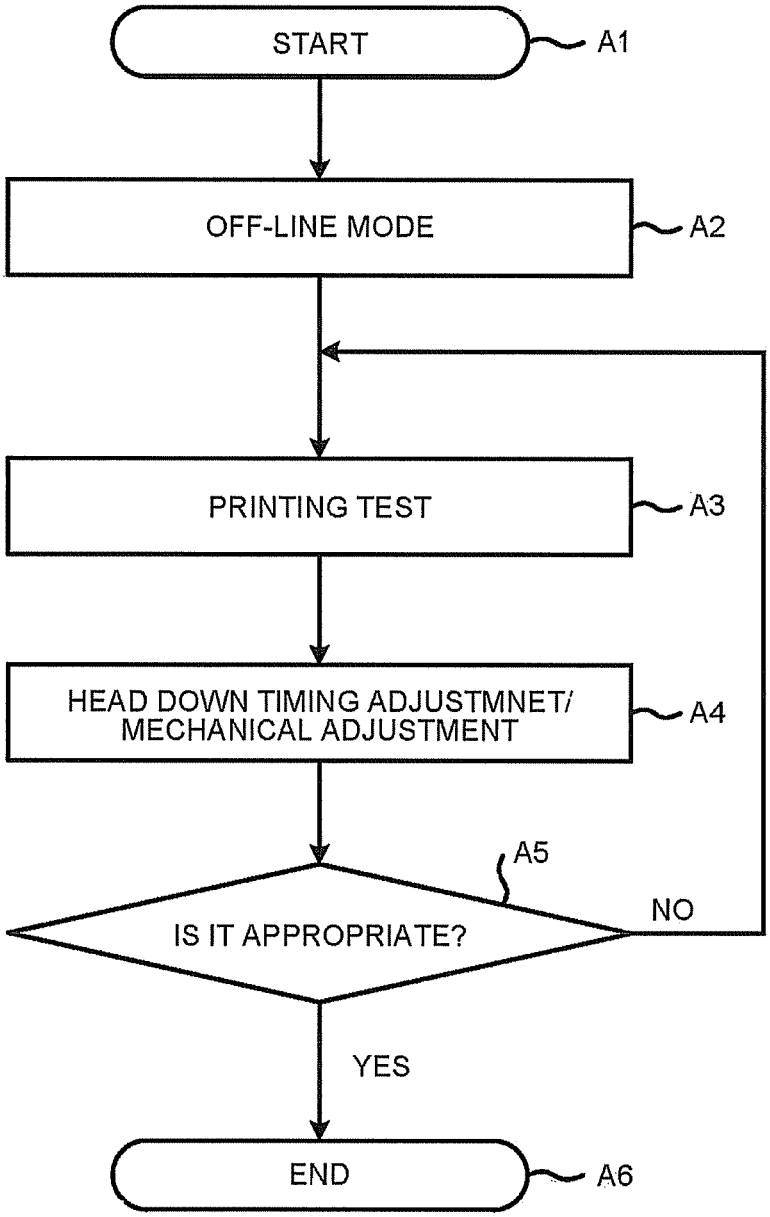
FIG. 7 is a flowchart illustrating an adjustment action of a head down of a thermal head of one embodiment.

According to a flowchart shown in FIG. 7, the variation of a timing of head down of the thermal head 35 or the mechanism can be adjusted by printing the test patterns 73, 74.

In FIG. 7, ACT A1 is start, for example it indicates a start of adjustment mode during maintenance. In ACT A2, it is set to be an off-line mode, at ACT A3 a printing test is carried out. In a printing test, the test patterns 73, 74 shown in FIG. 6 are printed onto the label paper 22; a conveyance distance L3 from the head up demand to actual head up, and a conveyance distance L4 from the head down demand to thermal head is actually fixed and printed are measured.

In a condition that the time from the head down demand to printing is actually carried out is different from the preset specified time, the conveyance distance L4 is also different from the specified distance. For example, when the conveyance distance L4 is longer than the specified distance the timing of sending head down demand is made earlier, and when the conveyance distance L4 is shorter than the specified distance the timing of sending head down demand is made later (at least when the conveyance distance L4 is longer than the specified distance, the timing sending head down demand is made earlier).

The demand timing of head down is carried out using the operation unit 15 and the display unit 16 of FIG. 4. For example, in the adjustment mode, an adjustment menu is displayed at the display unit 16. Then, the upward cursor key 61 and the downward cursor key 62 of the operation unit are operated, for example, if the upward cursor key 61 is pressed once, the timing of head down demand is set as +1, if the downward cursor key 62 is pressed once, the timing of head down demand is set as −1. The adjustment value +1, +2, . . . or −1, −2, . . . and the like are displayed at the display unit.

The control unit 41 controls the head control unit 50, when the thermal head 35 is made head down, the demand timing of head down is moved and fine-tuned based on the adjustment value (+1, −1 and the like). Therefore, the control unit 41 and the head control unit 50 constitute the adjustment unit that adjusts the movement timing of the thermal head 35.

Also, at ACT A4, the movement time from head down demand to the thermal head 35 is actually fixed can also be changed by a mechanical adjustment of a moving mechanism 36 (described below). Alternatively, both the movement timing adjustment and the mechanical adjustment of the thermal head 35 may also be carried out.

Moreover, even if the conveyance distance L3 from head up demand to actual head up deviates somewhat, the use amount of the ink ribbon in the non-printing area is changed somewhat, thus the timing is unnecessary to be adjusted, but the timing of head up can be adjusted by operating the keys of the operation unit 15 in a same manner with the head down.

After adjustment of ACT A4, at ACT A5, it is determined whether or not the timing is appropriately adjusted, if it's appropriately adjusted then the processing is ended by ACT A6, if it's not appropriately adjusted, then it returns to ACT A3 and carries out the adjustment again.

Figure 8:
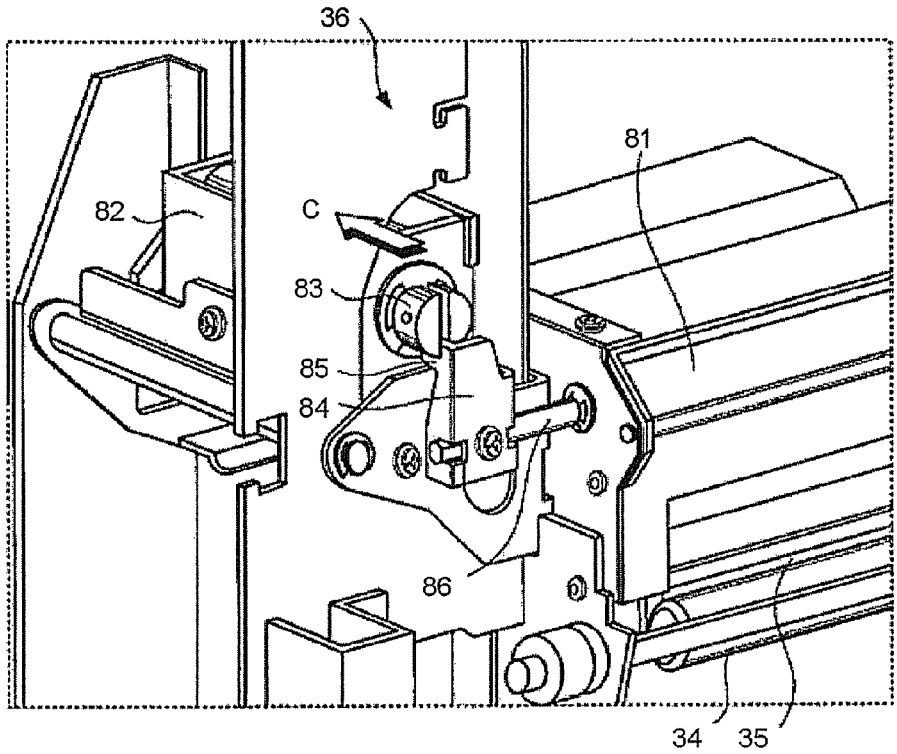
FIG. 8 is a perspective view illustrating a major part of a moving mechanism of the thermal head of one embodiment.

FIG. 8 is a perspective view illustrating the configuration of a major part of the moving mechanism 36 of the thermal head 35. In FIG. 8, the thermal head 35 is arranged at a lower part of a box 81 opposite to the platen roller 34.

Also, in order to raise or decline the thermal head 35, a solenoid 82 is arranged. The solenoid 82 is for example a pulling type, and a plunger 83 is pulled by leading an electric current into the coil. A distal end 85 of a movable body 84 is fixed in the plunger 83. The movable body 84 is installed at a shaft 86, when the plunger 83 bulges, it's in the state shown in FIG. 8, if the plunger 83 is drawn, the distal end 85 of the movable body 84 is drawn in a direction of arrow C, and the movable body 84 rotates only in a specified angle. The shaft 86 rotates with the rotation of the movable body 84.

A mechanism raising and declining the thermal head 35 is arranged within the box 81, if the plunger 83 is drawn and shaft 86 rotates, the thermal head 35 raises and departs from the platen roller 34. Also, in a state that the plunger 83 bulges, the thermal head 35 declines and contacts with the platen roller 34. Therefore, the time from the head down demand of the thermal head 35 to actual head down can be adjusted by changing the timing driving the solenoid 82.

Also, the movement time from the head down demand to the thermal head 35 is actually fixed can also be changed by a mechanical adjustment of the moving mechanism 36. As the mechanical adjustment, for example, an allowance is arranged at the connection between the plunger 83 and an distal end 85 of the rotatable body 84, the time until the solenoid 82 is driven and the rotatable body 84 rotates is changed by adjusting the allowance amount, and the time of head up or head down (movement time of the thermal head 35) may also be changed. Therefore, the unit carrying out the mechanical adjustment of the moving mechanism 36 constitutes the adjustment unit that adjusts the movement time of the thermal head 35.

Figure 9:
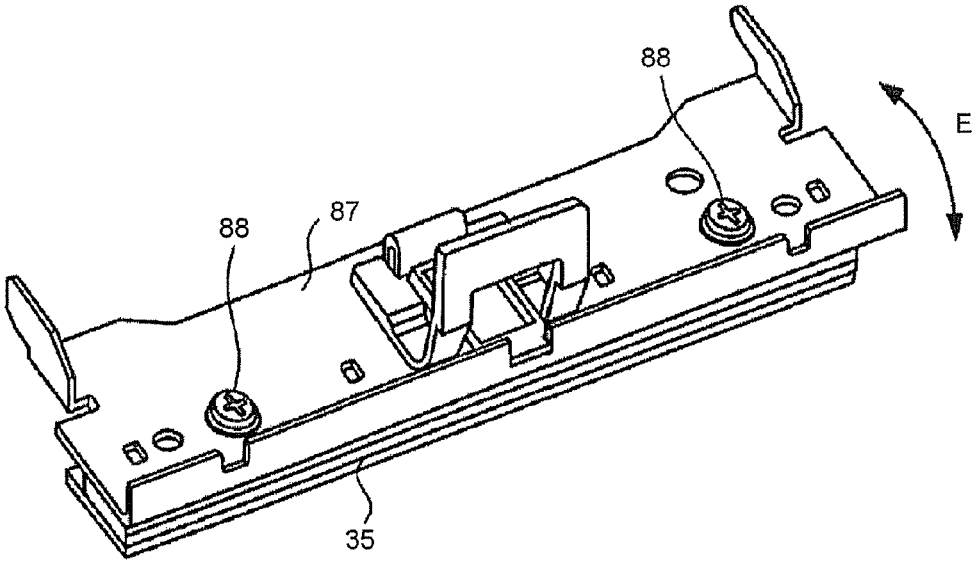
FIG. 9 is a perspective view illustrating a mechanism that corrects inclination of the thermal head of one embodiment.

FIG. 9 is a perspective view illustrating a correction mechanism that corrects the inclination of the thermal head 35 in a left and right direction (horizontal scanning direction). In FIG. 9, the thermal head 35 is fixed at the bottom face of the base member 87 by screws 88. When the test patterns 73, 74 of FIG. 6 are printed, if the positions of left and right test patterns 73, 74 deviate, it can be known that the thermal head 35 inclines. Therefore, the inclination can be adjusted by loosing the screws 88 and adjusting the thermal head 35 in a direction of arrow E.

According to the embodiment described above, the timing of head down (or head up) of the thermal head can be adjusted, thus the label image can be printed precisely.

Moreover, an example of discharging the printed paper D from the discharge port 14 is described above, but a mount peeling guide may also be arranged in the vicinity of the discharge port 14 within the housing 20. The mount peeling guide peels the label paper 22 off the mount 23 by bending the paper D just before the discharge port 14 at a steep angle, and the peeled label paper 22 is discharged from the discharge port 14. Moreover, the mount 23 may also be rewound by a mount rewinding mechanism.

Also, Also, the adjustment of the head down (or head up) is carried out during maintenance by setting the printing apparatus 10 to the off-line mode is described in the embodiment as example, the adjustment may also be carried out at a time of product factory shipment, or conducted by the operator with any timing.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a thermal head configured to have a heat generating element that thermally transfer ink of an ink ribbon onto a recording medium;

a conveying unit configured to convey the recording medium towards the thermal head along a conveyance path;

a platen member configured to be positioned opposite to the thermal head in the conveyance path;

a moving mechanism configured to move the thermal head between a first position where the ink is thermally transferred to the recording medium by pressurizing the platen member and a second position departing from the platen member; and an adjusting unit configured to, in a condition that the time of moving the thermal head from the second position to the first position is different from a specified time, adjust at least one of a movement timing of the thermal head and a movement time of the thermal head by the moving mechanism according to the difference between the time and the specified time.

2. The printing apparatus according to claim 1, wherein the adjusting unit prints test patterns onto the recording medium, measures a conveyance distance of the recording medium from the timing of receiving a command of moving the thermal head to the first position to the timing of the printing is actually carried out, and adjusts the movement timing of the thermal head towards the first position according to the conveyance distance.

3. The printing apparatus according to claim 1, wherein the moving mechanism includes a driving source configured to move the thermal head between the first position and the second position; and the adjusting unit adjusts a driving timing of the driving source and corrects the difference.

4. A printing method by a printer includes a thermal head having a heat generating element that thermally transfer ink of the ink ribbon onto a recording medium, comprising:

conveying the recording medium towards the thermal head along a conveyance path;

positioning a platen member at a position opposite to the thermal head in the conveyance path;

moving the thermal head between a first position where the ink is thermally transferred to the recording medium by pressurizing the platen member and a second position departing from the platen member; and in a condition that the time of moving the thermal head from the second position to the first position is different from a specified time, adjusting at least one of a movement timing of the thermal head and a movement time of the thermal head by the moving mechanism according to the difference between the time and the specified time.

5. The printing method according to claim 4, wherein printing test patterns onto the recording medium;

measuring a conveyance distance of the recording medium from the timing of receiving a command of moving the thermal head to the first position to the timing of the printing is actually carried out; and adjusting the movement timing of the thermal head towards the first position according to the conveyance distance.

* * * * *